US005233966A

United States Patent [19]

Berg

[11] Patent Number: 5,233,966

[45] Date of Patent: Aug. 10, 1993

[54] COMBUSTION ENGINE OF HIGH EFFICIENCY

[76] Inventor: Tore G. O. Berg, Backavägen 18, S-81040 Hedesunda, Sweden

[21] Appl. No.: 861,438

[22] Filed: Apr. 1, 1992

Related U.S. Application Data

[63] Continuation-in-part of Ser. No. 628,683, Dec. 17, 1990, abandoned.

[30] Foreign Application Priority Data

Nov. 12, 1990 [SE] Sweden ..... 9003593

[51] Int. Cl.[5] ..... F02M 25/07; F02G 1/04; F01B 29/10

[52] U.S. Cl. ..... 123/568; 60/517; 60/525

[58] Field of Search ..... 123/568; 60/517, 521, 60/522, 524, 525

[56] References Cited

U.S. PATENT DOCUMENTS

| | | | |
|---|---|---|---|
| 3,822,550 | 7/1974 | Brandenburg et al. | 60/525 X |
| 3,830,059 | 8/1974 | Spriggs | 60/520 |
| 3,978,680 | 9/1976 | Schukey | 60/519 |
| 4,138,847 | 2/1979 | Hill | 60/525 X |
| 4,270,351 | 6/1981 | Kuhns | 60/517 |
| 4,367,625 | 1/1983 | Vitale | 60/517 |
| 4,446,698 | 5/1984 | Benson | 60/517 X |
| 4,455,825 | 6/1984 | Pinto | 60/517 |
| 4,489,554 | 12/1984 | Otters | 60/517 X |
| 4,532,767 | 8/1985 | Watanabe et al. | 60/525 |
| 4,676,067 | 6/1987 | Pinto | 60/525 |
| 5,095,700 | 3/1992 | Bolger | 60/517 |

*Primary Examiner*—Willis R. Wolfe
*Attorney, Agent, or Firm*—Mason, Fenwick & Lawrence

[57] ABSTRACT

Combustion engine of high efficiency comprising two cylinders with a channel between them, each cylinder containing a sliding piston, said pistons being coupled such that they move synchronously and in opposite directions, or comprising a stator and a rotor, a duct shaped as a closed circle between said stator and rotor, at least one vane sliding in the duct and being fastened to the rotor, wherein the expansion takes place at a substantially constant temperature and at a substantially constant pressure.

6 Claims, 3 Drawing Sheets

COMBUSTION ENGINE OF HIGH EFFICIENCY

CROSS-REFERENCE TO RELATED APPLICATION

The present application is a continuation-in-part of U.S. patent application Ser. No. 07/628,683, filed Dec. 17, 1990, now abandoned.

FIELD OF THE INVENTION

This invention refers to a combustion engine of high efficiency operating according to the principles that a gas expands at a constant temperature by injection of fuel and air or oxygen or their reaction products during the expansion, and that the gas from a previous expansion is returned to the expansion chamber during the expansion in such a manner that the pressure of the expanding gas is also constant.

BACKGROUND OF THE INVENTION

Combustion engines now in use operate with adiabatic expansion of a gas. This means that the gas has an initially high pressure and an initially high temperature, and that it has a finally low pressure and a finally low temperature. The efficiency of the engine and the power output of the engine increase with increasing temperature difference between the initial state and the final state. At the final state the gas is exhausted into the environment. There is nothing one can do to reduce the pressure and/or the temperature of the final state. The effort toward more power and higher efficiency has therefore been directed toward raising the initial pressure and temperature. It is therefore necessary to cool the engine. Generally speaking $\frac{1}{3}$ of the combustion energy of the fuel goes to useful power, $\frac{1}{3}$ is lost by cooling and $\frac{1}{3}$ is lost with the exhaust.

SUMMARY OF THE INVENTION

According to the invention, the exhaust gas is returned to the expansion chamber, and its energy is used in a following expansion so that this energy loss is eliminated. Furthermore, according to the invention, the pressure and the temperature are held substantially constant during the expansion and, in principle, at the average values of those of the conventional engine so that, in particular, the temperature is reduced to a level that the material from which the engine is made, can endure. Therefore, no cooling is needed, and the loss of energy by cooling is also eliminated. As a consequence, the efficiency of the utilization of the energy of combustion is greatly increased at a given output of power and even at a greater output of power.

The combustion engine according to the invention operates at a substantially constant temperature and at a substantially constant pressure. This leads to the advantage that no cooling is needed and the heat losses are minimized. The heat in the exhaust is substantially completely utilized which considerably increases the efficiency of the engine.

Further advantages and characterizing features will become evident from the following detailed description.

SHORT DESCRIPTION OF THE DRAWINGS

In the drawings,

FIG. 1 schematically shows a cross sectional view of a two cylinder arrangement according to the invention, FIG. 2 schematically shows a cross sectional view of a rotating arrangement according to the invention, FIG. 3 shows a modification of the arrangement according to FIG. 1, FIG. 4 shows a modification of the arrangement according to FIG. 2, and FIG. 5 shows an alternative embodiment of a rotative arrangement.

DETAILED DESCRIPTION OF THE INVENTION AND PREFERRED EMBODIMENTS

In all figures, arrows show the directions of movement of elements and fluids.

Figure 1:
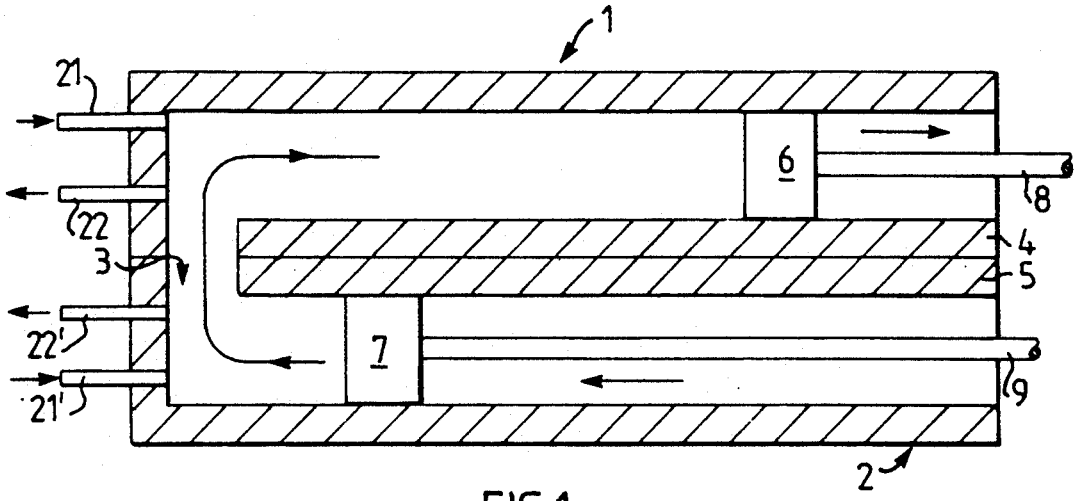

FIG. 1 shows one basic form of the invention. Two cylinders 1,2 are mounted together with a channel 3 through the walls 4,5 between them. There is a sliding piston 6 and 7, respectively, in each cylinder. The two pistons 6,7 are via rods 8,9 coupled in such a manner that the pistons move synchronously and in opposite directions. The volume between the two pistons is then constant. Therefore, when the volume in one cylinder, the "compressor", decreases, the volume in the other cylinder, the "motor", increases by the same amount. When the volume between the pistons is filled with a gas of volume V, pressure P, and temperature T, the gas will flow from the cylinder of decreasing volume to that of increasing volume and without change of V, P or T.

If the "compressor" is disconnected and the channel 3 is closed, the gas in the "motor" will expand and give work, such as to a crankshaft. If heat is supplied to the gas in such a manner that the temperature of the gas is held constant, the expansion will be isothermal. All the heat supplied is then converted to work, but the pressure will decrease. When V denotes the initial volume of gas in the motor, the gas law gives $$PV_m = NRT \tag{1}$$

where N is the number of moles of gas in the volume $V_m$ and R is the gas constant. Derivation gives, when T and N are constant $$PdV_m + V_m dP = 0 \tag{2}$$

Thus, $dP < 0$ and P decreases $$P = \frac{NRT}{V} \tag{3}$$

If this experiment is repeated with the "compressor" connected and channel 3 open, a volume $dV_m$ will be transferred from the "compressor" to the "motor". In this transfer there is no energy change in the gas. The "motor" simply receives an amount dN of gas. According to (1)

$$PdV_m = RTdN \tag{4}$$

This gives instead of (2)

$$PdV_m + V_m dP = RTdN = PdV_m \tag{5}$$

Hence, in this case $$V_m dP = 0 \tag{6}$$

i.e. P is constant. Thus, all the heat supplied is converted to work, and the initial state P, V, T is maintained during the expansion. When the stroke is completed, the pistons reverse their directions and gas is transferred from the "motor" to the "compressor". The "motor" now becomes the "compressor", and the "compressor" becomes the "motor". At the turning point the heat supply to the "motor" is discontinued and heat is supplied to the "compressor" that now becomes the "motor".

In this manner gas will flow back and forth between the two cylinders without change and all the heat supplied to the system will be converted to work. The thermal efficiency of the engine is 100%. The work delivered with each stroke of each piston is PV or NRT, and both pistons together deliver 2PV or 2NRT per cycle.

To the mathematical description of the continuum by means of differentials corresponds a physical description by means of intermittent and alternating steps. Thus, the channel between the two cylinders in FIG. 1 is alternatingly closed and open, and the supply of heat is alternatingly open and closed. When the channel is closed, the gas in the "motor" expands isothermally a small amount $\Delta V$, whereby the work of expansion is $$\begin{aligned} &\textit{isothermal work} = Pv\ ln[(V+\Delta V)/V] = PV \\ &ln(1+\Delta V/V) = P\Delta V \end{aligned} \tag{7}$$

This work is equal to the amount of heat supplied. At the same time the gas in the "compressor" is compressed adiabatically by the amount: $\Delta V$. The channel is now opened, and the heat supply is closed. The gas in the "compressor" expands adiabatically by the amount $\Delta V$ into the "motor" to the initial state P, V, T. It thereby delivers work equal to the previously received work of adiabatic compression. Thus, the total gas is restored to its initial state. The net result is the work $P\Delta V$ from the heat and the increase of the amount of gas in the motor by the amount $\Delta N$. This cycle can be repeated any number of times. At the end of the stroke the gas is unchanged, and the motor has delivered work to the crankshaft equal to the amount of heat supplied to the gas in the motor, namely according to (7)

$$\textit{total work} = \Sigma P\Delta V = P\Sigma\Delta V = P(V_2 - V_1) \tag{8}$$

where P is the initial and final pressure and $V_2 - V_1$ is the volume of the stroke. The work per cycle is twice this amount.

In practice it is necessary to supply heat to the gas by injecting fuel and air or oxygen or their reaction products into the "motor" cylinder during the expansion, which is done through an inlet 21,21'. This requires the fuel and air or oxygen or their reaction products to be compressed to the pressure in the "motor". This added volume of gas must be removed from the system before the end of the stroke, preferably from the "compressor", which is done through an outlet 22'. If the gas is simply released to the ambient, it constitutes a loss that is the sole loss of energy from a frictionless system.

Control of the injection of fuel and air/oxygen in a combustion process is well known for the man skilled in the art. Examples of systems on the market are those manufactured by Bosch GmbH.

In the basic form of the invention the fuel is burnt in a separate combustion chamber outside the engine. The hot combustion products are injected into the expansion chamber as indicated by the arrows in the figures and at the rate that they are produced. This mode of combustion is not new. It is used by Mazda in their adaptation of the Wankel engine to $H_2$ as a fuel. It is necessary with explosive fuels, such as $H_2$, and with fuels that are hard to burn completely, such as CO, and generally when control of the combustion process is required. A major advantage is that it allows the use of catalysts for the combustion process.

If the pressure in the motor is 10 kg/cm$^2$ and the initial pressure of the fuel+air is 1 kg/cm$^2$ and its temperature is 0° C., the compression of this gas costs an amount of work $$W = \frac{P_1V_1}{\kappa - 1} \times \left(\frac{T_2}{T_1} - 1\right) \tag{9}$$

Compression to 10 kg/cm$^2$ raises the temperature by a factor $$10^{\frac{\kappa-1}{\kappa}} = 10^{0.286} = 1.931$$

with $\kappa = 1.4$. Hence, $T_2 = 1.931 \times 273°$ K. $= 527°$ K. $= 254°$ C. This temperature is chosen for simplicity as the temperature of the gas in the motor. This value of $T_2$ inserted in (9) gives $$W = \frac{1 \times 22.4 \times 10^3}{0.4} \times \frac{254}{273} = 52{,}1 \times 10^3 \text{ kgcm} = \tag{10}$$

$$521 \text{ kgm} = 1.22 \text{ kcal}$$

for one mole of fuel+air. If the fuel is $CO+H_2$, the combustion gives $CO_2+H_2O$ and a heat of combustion of 67+57=124 kcal. The amount of air required is $O_2+4N_2$, a total of 7 moles. Hence, $W = 7 \times 1.22 = 8.54$ kcal, i.e, 8.54/124=6.9%. The thermal efficiency of the engine is 100−6.9=93.1%. The effective energy is 124−8.5=116 kcal=$50 \times 10^3$ kgm. At P=10 kg/cm$^2$ this corresponds to $$\frac{50 \times 10^3}{10 \times 10^{-2}} = 5 \times 10^5 \text{ cm}^3 = 500 \text{ l}$$

and at 0° and 1 kg/cm$^2$ a volume of 500×5.188=2594 liter. The volume of 7 moles of fuel+air is 7×22.4=156.8 liter or $$\frac{157}{2594} = 6.1\%$$

Thus, 93.9% of the gas is recirculated.

If the fuel is ethanol, $C_2H_5OH$, the combustion products are 2 $CO_2$+3 $H_2O$ by reaction with 3 $O_2$ or 3 ($O_2$+4 $N_2$)=15 moles of air and a heat of combustion of 328 kcal. After combustion the number of moles is 5+12=17. The work of compression is, with (10), 17×1.22=20.7 kcal or 20.7/328=6.3% of the heat of combustion. The thermal efficiency is 100−6.3=93.7%. The effective energy is 328−20.7=307 kcal=$131 \times 10^3$ kgm. At P=10 kg/cm$^2$ this corresponds to $131 \times 10^3 / 10 \times 10^{-2} = 13.1 \times 10^5$ cm$^3$=1310 liter and at 0° C. and 1 kg/cm$^2$ a volume of 1310×5.188=6796 liter. The volume of 17 moles of combustion products is at 0° C. and 1 kg/cm$^2$ 17×22.4=381 liter or 381/6796=5.6%. Thus, 94.4% of the gas is recirculated.

It follows from these examples that the greater part of the work of compression and of the amount of exhaust is due to $N_2$. An appreciable improvement can be obtained only by the use of oxygen instead of air. It also follows that the choice of fuel does not appreciable affect the performance of the engine in these respects.

The engine shown in FIG. 1 is an adaption of the conventional piston engine to the principles of the invention: No compression stroke is needed because the circulating gas has a sufficient pressure. No exhaust stroke and no intake stroke are needed because the exhaust of one cylinder is the intake of the other cylinder.

In a similar manner the Wandel engine can be converted into the rotational form of the invention. The rotor of the Wandel motor is fitted with three vanes, but in order to describe its functioning one pair of vanes, 120° apart, sufficies. The vanes fit tight to the surface of the stator. In the course of a revolution the volume enclosed between rotor, vanes, and stator varies because the distance between rotor and stator varies. In the first part of the revolution this volume is open to the ambient and a source of fuel and those gases are sucked into the engine while the volume is constant. In the second part the volume decreases and causes the compression of the gas. In the third part the fuel is ignited and the volume gradually increases so that the gas expands increasingly. In the last part of the revolution the volume opens to the ambient, and the gas is exhausted.

The fundamental principle of the Wankel engine is one of mechanics: A system changes in the direction of decreasing potential energy. Force as a concept is defined as potential gradient, a vector. The Wankel engine turns in the direction of expansion, i.e. decreasing potential energy. In the case at hand and in terms of measurable quantities the potential is represented by the pressure and the temperature.

In FIG. 1 pressure is converted to force, namely in the direction of expansion, i.e. The motion of the motor piston. At a constant value of N the supply of heat can maintain a constant temperature, and then all of the heat is converted into work. But if one supplies enough heat to maintain a constant pressure, no more than a small fraction of it, $$\frac{\kappa - 1}{\kappa} = \frac{0.4}{1.4} = \frac{1}{3.5}$$

is converted into work. The reason why the pressure is maintained constant in the engine shown in FIG. 1, when the temperature is maintained constant, is that N increases by the supply of gas of the same temperature and pressure from the compressor.

The Wankel engine can be adapted to the principle of the invention by connecting it to another Wankel engine in such a manner that the outlet of one is the inlet of the other. The gas then circulates back and forth between the two engines as in FIG. 1. When the products of the fuel injected in the system are not removed, a pressure will build up that suffices for the desired torque, and no compression is needed. The engine is thus reduced to the expansion part of the normal engine. But since the pressure is the same in the entire system, only one vane is needed. The fuel is injected and burned behind this vane as in FIG. 1. This has the same effect as a compression, the gas expands at a constant temperature and a constant pressure as in FIG. 1, all the heat supplied being converted into work.

Figure 2:
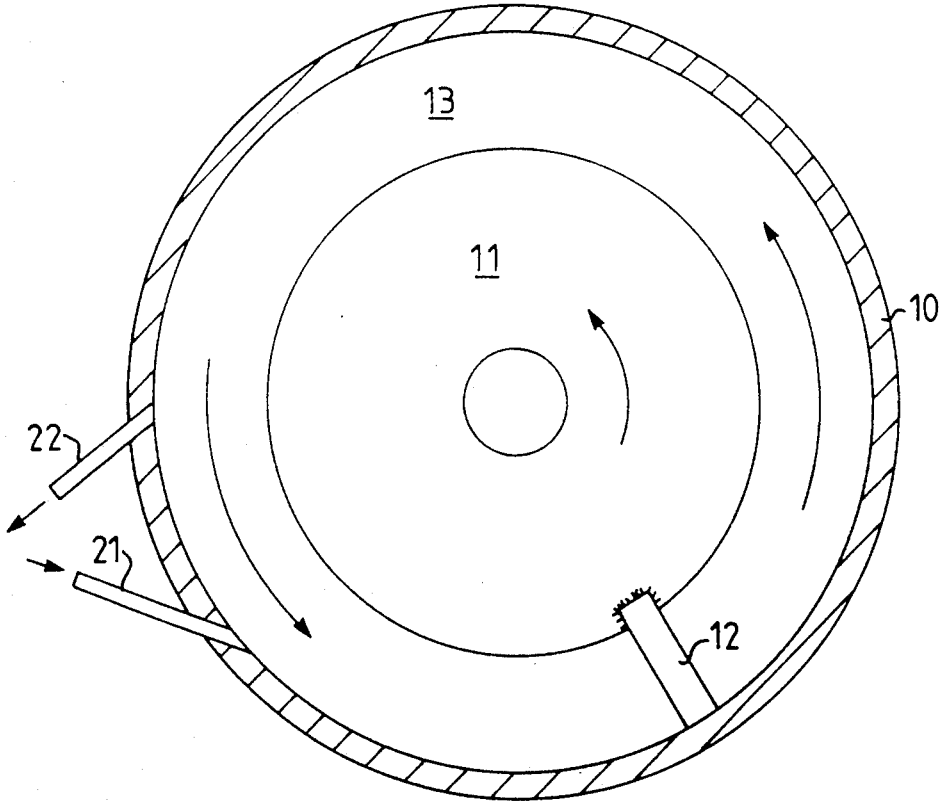

This reasoning leads to the engine shown in FIG. 2. It is the rotational form of the linear engine in FIG. 1. The engine is composed of a stator 10 and rotor 11. The rotor carries a vane 12 that fits into a channel 13 in the stator and slides in it. The motor and the compressor are separated by the vane, the gas in the motor is heated, the gas in the compressor is not heated.

The functioning of the engine shown in FIG. 2 is as follows. As a result of the motion of the vane, the gas upstream the vane is compressed and the gas downstream the vane expands. The expanding gas suffers a decrease of pressure and a decrease of temperature. The temperature is restored by the supply of heat. The loss of pressure is compensated by the supply of more gas. This new gas expands and loses temperature, it takes up heat and produces work. To the work corresponds a force that has the direction of the expansion, i.e. toward the vane. The magnitude of this force is the pressure of the expanding gas times the area of the vane. When the compressed gas expands, it gives off its work of compression as work of expansion. The net effect is that heat is converted to work, the gas does not change.

A necessary condition for this functioning of the engine is that the flow velocity be greater than the rate of diffusion in the gas. Since the pressure difference is small, the rate of diffusion is also small. Another necessary condition is that the flow velocity be greater than the velocity of heat conduction. This condition would be satisfied even at small flow velocities. Clearly, if these conditions are not satisfied, i.e. at a very small flow velocity, there would be internal equilibrium in the gas, and the supply of heat would merely heat the gas.

Of course, the same result is obtained by applying the equations (1)–(6) to an incremental transfer of gas.

A necessary condition for the recirculation of the gas is that the state of the gas in terms of P, V and T remains constant over a period of time. It is not necessary that P and T remain constant over every small fraction of a cycle, only that the variations are within acceptable bounds through several cycles. The condition (4) is given by the design of the engine, it is always and automatically satisfied. But the condition $$VdP = NRdT = 0 \qquad (11)$$

depends on the rate of supply of heat and thereby on the reliability of the burner and its controls. It is noteworthy that dP is proportional to dT. Therefore, the deviations of P and T are corrected by the same measure, namely the adjustment of the rate of supply of heat. When the heat is supplied in the form of a stream of heated gas, the velocity of this gas should be equal to the velocity of the piston or the vane. The vane moves at a constant velocity through the stroke, and the stream of heated gas should contain a certain constant amount of heat per unit of volume that is given by the load. The piston moves at a variable velocity that is zero at the turning points. Ideally, the velocity of the stream of heated gas should vary in the same manner. Practically, it may suffice to approximate the ideal velocity so that the state of the expanding gas is the same at both turning points.

With a recirculating gas deviations from (11) in one stroke can be compensated in a later stroke. In an engine without recirculation of the gas a deviation from the ideal operation in one stroke cannot be compensated in a following stroke since the gas is exhausted.

In the engine according to the invention the heat is supplied over the entire stroke. In the conventional engine with adiabatic expansion the heat is supplied in a small fraction of the stroke. The rapid burning of the fuel poses a tougher problem in the case of the adiabatic expansion.

Figure 3:
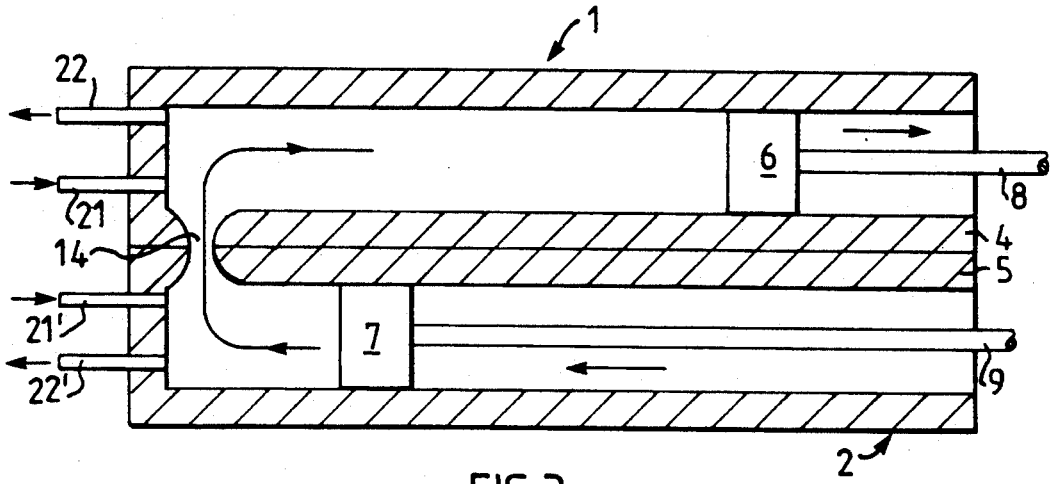
Figure 4:
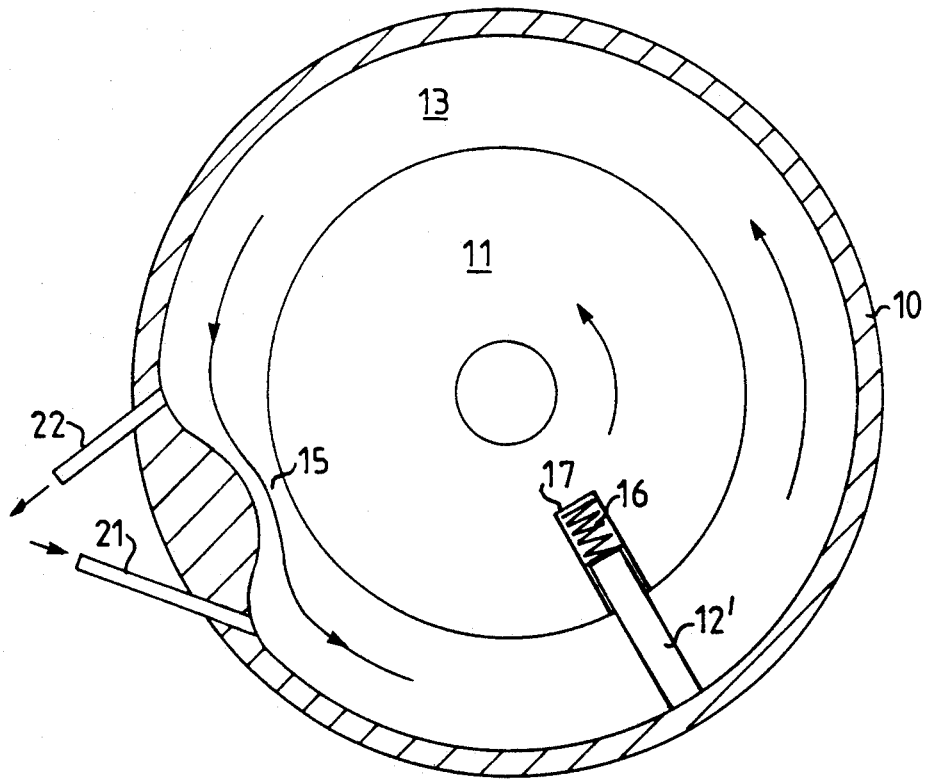

At the reversal of the directions of the pistons in FIG. 1 the pressure gradient is zero. It may be preferable to shape the channel between the two cylinders as a constriction or to close it until the motion has gotten under way for otherwise the heat may flow into the compressor. This precaution is not so much needed in the rotational form in FIG. 2. FIG. 3 and FIG. 4 show how it may be made in the two cases with a constriction 14, FIG. 3, and a constriction 15, FIG. 4. In order to accommodate this constriction 15, the vane 12' is resiliently mounted in the rotor 11, as shown with the aid of a compression spring 16, arranged in a bottom hole 17 in the rotor, or in some other suitable manner.

The output power of the engine is proportional to the product PV, the number of revolutions per minute, and the number of engines operating on the same crankshaft or mounted on the same shaft. The power output can be reduced by closing the supply of heat to one engine or several engines altogether or for every second, third, fourth etc. cycle of one engine. In order to reduce P, one may let out more gas. The energy loss is then recovered when the load increases and P is increased by letting out less gas. Of course, the heat input must be changed to suit the changed pressure.

FIGS. 1 and 2 show the two basic designs of the engine, one for linear and one for rotational motion, depending upon the nature of the load. The invention has the advantage as compared to conventional engines that it can be adapted to the load in various ways. One such feature is that it can be combined into assemblies: of many engines. This allows a standardized unit of the engine and the assembly of a number of these units into one machine within a wide range of power output. This system facilitates the adjustment of the assembly to variations of the load. Another such feature is that the length of the stroke of the piston engine is almost without limit. This makes it possible to adjust the engine to a load of great torque and small velocity.

Figure 5:
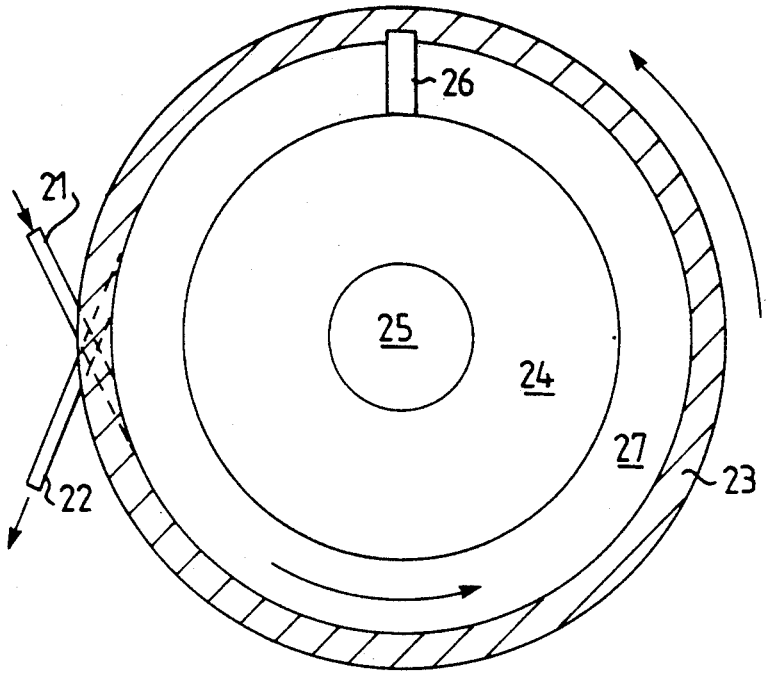

A variation on the basic design that demonstrates its flexibility is shown in FIG. 5. In this case the outer rim 23 of the engine is the rotor. It can carry e.g. The winding of the rotor of an electric generator. The rotor 23 rotates around the stator 24 mounted on a stationary shaft 25. A vane 26 is mounted in the rim 16 and having the same function as discussed with the embodiments according to FIGS. 2 and 4. The gas and the vane is moving as indicated by the arrows in the channel 27. This application is possible because the engine operates at a low temperature and does not need cooling.

At the low pressure of the recirculating gas it is well possible to use pressed sheet metal for the construction of the engine. At the low operating temperature of the engine it is even possible to use synthetic plastics.

In view of this variety of application, adaptation, and modification it is not possible to specify one design or one construction or one preferred embodiment of an engine according to the invention. They are all variations on the basic designs shown in FIGS. 1 and 2.

I claim:

1. A combustion engine of high efficiency comprising: two cylinders with a channel between them, each cylinder containing a sliding piston, said pistons being coupled in such a manner that they move synchronously and in opposite directions so that a volume between the two pistons is always the same, said volume containing a gas at a pressure and a temperature that are higher than those of ambient air, said gas being transferred back and forth between the two cylinders;

wherein the temperature of the gas in the cylinder of increasing volume is maintained substantially constant by injection of a fuel and oxygen or air, or the hot gaseous combustion products thereof, and the pressure of the gas in the cylinder of increasing volume is maintained substantially constant by the supply of gas from the cylinder of decreasing volume;

wherein an amount of gas equal to an injected amount of heating gas is exhausted from the cylinder of decreasing volume; and wherein each cylinder is provided with an inlet and an outlet for injection of heating gas and exhaust of added gas, respectively.

2. The combustion engine according to claim 1, wherein the channel between the two cylinders is provided with a constriction.

3. The combustion engine of claim 1, wherein:

gas is passed continuously back and forth between the two cylinders.

4. The combustion engine of claim 1, wherein:

gas passes intermittently back and forth between the two cylinders.

5. The combustion engine of claim 2, wherein:

the channel between the two cylinders is provided with a permanent constriction.

6. The combustion engine of claim 2, wherein:

the channel between the two cylinders is provided with an intermittent constriction.

* * * * *